United States Patent [19]

Balzer

[11] Patent Number: 4,568,587

[45] Date of Patent: Feb. 4, 1986

[54] ROLL-UP FLOOR MAT WITH RIGID RAILS

[75] Inventor: Claude P. Balzer, Wichita, Kans.

[73] Assignee: Balco, Inc., Wichita, Kans.

[21] Appl. No.: 305,445

[22] Filed: Sep. 25, 1981

[51] Int. Cl.[4] ..... E04C 1/30; E04F 15/16

[52] U.S. Cl. ..... 428/52; 52/71; 52/177; 52/586; 428/58; 428/85; 428/192

[58] Field of Search ..... 15/217, 215, 238, 239; 52/71, 177, 181, 586; 428/62, 85

[56] References Cited

U.S. PATENT DOCUMENTS

| | | | |
|---|---|---|---|
| 3,383,822 | 5/1968 | Viehmann et al. | 52/667 |
| 3,592,289 | 7/1971 | Aysta et al. | 52/586 X |
| 3,783,471 | 1/1974 | McGeary | 15/215 |
| 3,808,628 | 5/1974 | Betts | 15/215 |
| 4,029,834 | 6/1977 | Bartlett | 15/215 X |
| 4,276,728 | 7/1981 | Balzar | 52/177 |

FOREIGN PATENT DOCUMENTS

| | | | |
|---|---|---|---|
| 477288 | 6/1929 | Fed. Rep. of Germany | 15/217 |

*Primary Examiner*—Paul J. Thibodeau

*Attorney, Agent, or Firm*—Schmidt, Johnson, Hovey & Williams

[57] ABSTRACT

A floor mat including a plurality of rigid, elongated rails each having a side edge positioned in substantially parallel, spaced relationship to a respective side edge of an adjacent rail. A passageway opens inwardly from each rail side edge and includes an outer portion adjacent the side edge and an inner portion. The passageway inner portions have greater cross-sectional dimensions than the passageway outer portions. Each pair of adjacent rails is interconnected by an elongated, flexible hinge member which comprises a pair of opposite, spaced flanges extending longitudinally with respect to the hinge member. The flanges are interconnected by a web having a cross-sectional thickness less than a cross-sectional thickness of each of the flanges. The hinge member flanges are each slidably received in a respective passageway inner portion. The hinge member is adapted to maintain the rails in a substantially parallel, predetermined spacing and to bend transversely with respect to the rails thereby allowing transverse angular displacement of the rails relative to each other.

16 Claims, 8 Drawing Figures

ROLL-UP FLOOR MAT WITH RIGID RAILS

BACKGROUND OF THE INVENTION

1. Field of the Invention.

This invention relates to floor mats, and in particular to a roll-up floor mat with rigid rails.

2. Description of the Prior Art.

A variety of grills, grates, grids and mats for floors have been developed for removing dirt, water and other foreign matter from the footwear of persons walking thereover. Such devices are typically placed adjacent the entrances of structures which are desired to be protected from the intrusion of such foreign matter.

One type of prior art floor grill or grate is adapted to span a pit wherein dirt and debris accumulate and has sufficient integral strength to support persons walking or standing thereon. Such devices may be comprised, for example, entirely of closely-spaced metal bars placed over such a pit and substantially flush with a floor or sidewalk surface. Although such grills are relatively durable and self-cleaning and thus require little attention, the hard surfaces thereof are relatively ineffective for removing and accumulating dirt, water and other foreign matter. Therefore, various devices have been invented which include tread surfaces of material selected for their durability and their ability to remove or retain such foreign matter. For example, the McGeary et al U.S. Pat. No. 3,783,471 shows a foot grill with replaceable carpet strips placed on bars maintained in a parallel, spaced relation by transverse connecting members. Also, a dirt removing grid system for floors is disclosed in my U.S. Pat. No. 4,276,728 which shows a plurality of parallel, spaced tread rails with dirt removing upper surfaces and a connecting system for attaching the rails to transverse spacer channels. However, such grills and gratings require substantial pits therebeneath for the accumulation of foreign matter and also require substantial structures which are frequently complex and expensive to span such pits. Further, such grills and gratings are difficult and expensive to add to an existing building not provided with the necessary pit.

Floor mats are also known which are directly supported by a floor surface and may either be placed directly thereon or in a slight recess. However, such floor mats require more frequent cleaning than the previously described grill and grating systems because less space is provided for the accumulation of foreign material. The capacity of such a floor mat to accumulate foreign material is generally limited by the amounts which may be retained in the tread material and in the available space adjacent the rails and in the floor recess. As such spaces fill with dirt, or become saturated with water, the floor mat tends to lose its ability to clean the footwear of pedestrians passing thereover. Therefore, periodic cleaning is necessary to maintain the effectiveness of such floor mats.

To facilitate the cleaning of such floor mats and the surfaces thereunder, they are generally removable. Such removal may frequently be best accomplished by rolling up the floor mat, and roll-up floor mats are well known in the art. Integral, one-piece floor mats of an elastomeric material are relatively economical and may be rolled up for removal. However, the tread surfaces of such floor mats are generally not replaceable and lack the cleaning ability of fibrous materials, such as carpet. Also, such one-piece floor mats lack the strength and durability of those having rigid rails comprising, for example, brass or aluminum.

The Bartlett U.S. Pat. No. 4,029,834 shows a floor mat with rigid rails which are hinged to allow the floor mat to be rolled up. A hinging action between adjacent rails is provided by a ball and socket fastening system at their respective edges to allow transverse pivoting therebetween. However, the connecting system for the rails shown in that patent comprises balls and sockets which are integral with and of the same rigid material as the rails and therefore, do not accomodate relative vertical displacement therebetween for a cushioning effect. Also, fasteners are required to prevent relative shifting between adjacent rails. Further, along one side, a different type of rail is required having a socket configuration along both of its edges to receive a lead-in member, thereby preventing the use of a single, cross-sectional configuration for all the rails in that type of floor mat. Therefore, prior art floor grills, grates and mats have tended to be relatively ineffective for removal of foreign matter, vulnerable to extensive wear, or complex to manufacture, necessitating a relatively high cost to the user.

SUMMARY OF THE INVENTION

In accordance with the present invention, a floor mat is provided which comprises a plurality of rigid, spaced elongated rails each having opposite side edges. A passageway extends inwardly from each side edge and includes an inner portion having a greater cross-sectional dimension than an outer portion of the passageway. An elongated hinge member is provided having spaced, opposite flanges extending longitudinally thereof. The flanges are interconnected by a web having a thickness less than that of the flanges. The flanges are each slidably received in a respective passageway inner portion. The flexible hinge members thereby allow transverse angular displacement of adjacent rails relative to each other for rolling up the floor mat of the present invention. The flexible hinge members also serve to maintain the rails in closely-spaced, parallel, predetermined position and provide for a cushioning effect when the floor mat is walked upon by allowing a limited amount of vertical displacement of the rails relative to each other. The rigid rails include channels for removably receiving replaceable carpet strips and include lips extending inwardly with respect to the channels for retaining the carpet strips. The rigidity of the elongated rails provides for a relatively durable floor mat capable of withstanding heavy traffic conditions. The floor mat of the present invention is adapted for placement either in a shallow recess in a floor surface with its upper surface flush therewith or for surface mounting directly on a floor surface surrounded by tapered threshold members.

Accordingly, the principle objects of the present invention are: to provide a floor mat adapted to be supported on a floor surface or in a shallow recess; to provide such a floor mat which may be rolled up; to provide such a floor mat with rigid, elongated rails; to provide such a floor mat with flexible hinge members interconnecting adjacent rails and maintaining same in a predetermined, close-spaced relationship; to provide such a floor mat wherein the rails are adapted to removably receive a replaceable strip of fibrous material; to provide such a floor mat which provides a cushioning effect when walked on; to provide such a floor mat with a relatively low profile; to provide such a floor mat wherein all of the rails have an identical cross-sectional configuration; and to provide such a floor mat which is economical to manufacture, efficient in use, comprised of durable materials, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein, are not to be interpreted as limiting, but merely as a basis for the claims and as a representative basis for teaching one skilled in the art to variously employ the present invention in virtually any appropriately detailed structure.

Figure 3:
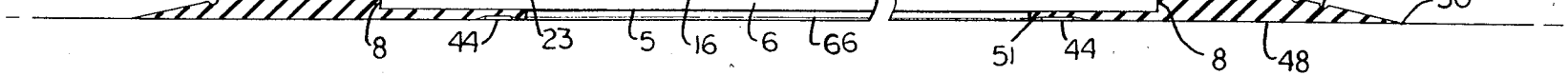
FIG. 3 is an enlarged fragmentary, longitudinal cross-sectional view of the floor mat taken generally along line 3—3 in FIG. 1.
Figure 7:
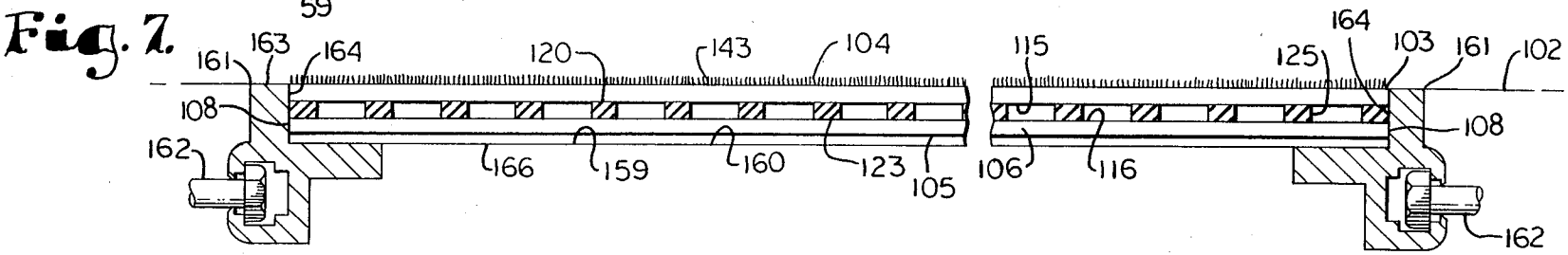
FIG. 7 is an enlarged fragmentary, longitudinal cross-sectional view of the floor mat taken generally along line 7—7 in FIG. 5.

For purposes of description herein, the terms "upper", "lower", "right", "left", "rear", "front", "vertical", "horizontal", and derivitives thereof shall relocate to the invention as oriented in FIG. 3 for the first embodiment and FIG. 7 for the second embodiment. However, it is to be understood that the invention may assume various alternative orientations, except where expressly specified to the contrary.

The reference numeral 1 generally designated a floor mat for placement on a horizontal plane or support surface 2 comprising, for example, a floor surface or sidewalk surface. The floor mat 1 comprises a plurality of rigid, elongated rails 3 each displaying a serrated upper surface 4 and a lower surface 5, opposite side edges 6 and 7, and opposite ends 8 and 9. The rails 3 are preferably formed by extruding a corrosion resistant metal such as brass or aluminum, into a desired cross-sectional configuration. Each rail 3 includes passageways 10 opening onto its side edges 6 and 7. The passageways 10 have T-shaped cross-sectional configurations with inner portions 11 and outer portions 12. The passageway outer portions 12 are positioned adjacent respective rail side edges 6 and 7 and have narrower cross-sectional dimensions than respective passageway inner portions 11. The passageways 10 extend longitudinally of respective rails 3 and terminate at their ends 8 and 9. The outer portion 12 of each passageway 10 is defined by a pair of mutually opposed upper and lower ribs 15 and 16 positioned in parallel, spaced relationship adjacent a respective rail side edge 6 or 7.

Figure 2:
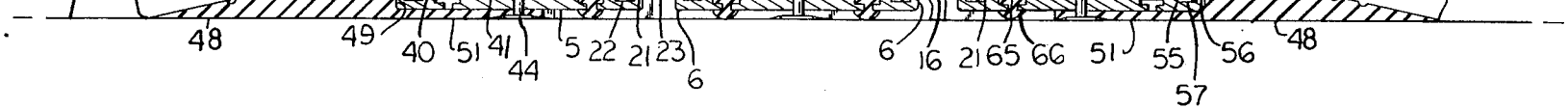
FIG. 2 is an enlarged, fragmentary, transverse cross-sectional view of the floor mat taken generally along line 2—2 in FIG. 1.

Each adjacent pair of rails 3 is pivotably interconnected by a respective flexible hinge member 20 positioned therebetween and extending longitudinally thereof. The hinge members 20 each include a web 23 with opposite side margins 21 and opposite, spaced flanges 22 integrally connected to the web 23 at the side margins 21. The web 23 has a cross-sectional thickness substantially less than a cross-sectional thickness of the flanges 22. As shown in FIG. 2, the hinge members 20 have horizontal I-shaped cross-sectional configurations, portions of which correspond to the cross-sectional configurations of the passageways 10.

Figure 4:
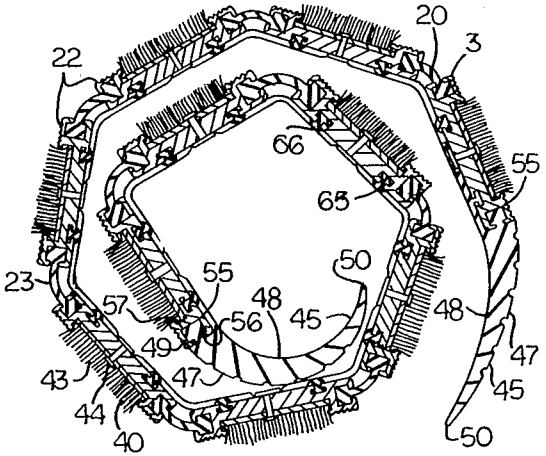
FIG. 4 is an enlarged, transverse, cross-sectional view of the floor mat in a rolled-up position.

The hinge member flanges 22 are each slidably received in a respective passageway inner portion 11. The web side margins 21 are slidably received in respective passageway outer portions 12 between respective upper and lower ribs 15 and 16. The hinge members 20 are thereby each secured to a respective adjacent pair of rails 3 and function to maintain mutually opposed rail side edges 6 of adjacent pairs of rails 3 in a predetermined spaced, relationship. The hinge members 20 preferably comprise a flexible, resilient material, for example vinyl, whereby the hinge member webs 23 are adapted to bend transversely about their longitudinal axes and allow transverse angular displacement of the rails relative to each other. Because of their relatively narrow cross-sectional thicknesses, the webs 23 are readily adapted for such transverse bending as well as for spacing the thicker flanges 22. The flexible material comprising the hinge members 20 is preferably of a material having a sufficient durometer to resist buckling whereby the rails 3 are maintained in a predetermined, spaced relationship, but are sufficiently flexible to allow transverse bending about their longitudinal axes whereby the floor mat 1 may be rolled up to a configuration as shown in FIG. 4.

Each hinge member 20 includes a plurality of longitudinally spaced cut-outs 25 extending through the web 23 thereof and adapted for allowing dirt, water and other foreign matter to pass therethrough below the level of the hinge member webs 23. Such foreign matter is thereby at least partially removed from the hinge member webs 23 and thus prevented from being transferred to the footwear of persons walking over the floor mat 1.

Each rail 3 includes a channel 30 opening upwardly onto its serrated upper surface 4 and comprising a bottom surface and a pair of opposed side walls 32. A pair of lips 33 each extend inwardly in mutually opposed relationship from respective side walls 32 adjacent respective rail upper surfaces 4 and in spaced relation from respective channel bottom surfaces 31. A pair of mutually opposed slots 34 opening inwardly into each channel 30 are thereby defined by respective side walls 32, lips 33 and the channel bottom surface 31.

A plurality of strips 40 comprising a fibrous material, for example carpet, are each removably secured in a respective channel 30 and extend longitudinally of a respective rail 3. Each strip 40 includes a semi-rigid backing 41 with opposite side edges 42 and a fiber pile 43. The side edges 42 of each strip backing 41 are received in the inwardly-opening slots 34 of a respective rail 3. Preferably, the strip backings 41 are also attached with a suitable adhesive to respective channel bottom surfaces 31 and with mechanical fasteners such as rivets 44 extending through the rails 3 and the strip backings 41. Such adhesive should preferably be of sufficient strength to assist in retaining the strips 40 properly positioned in respective channels 30, but yet not so strong as to prevent the removal of the strips 40 for replacement. When each strip 40 is positioned in a respective channel 30 with its backing side edges 42 extending into respective channel slots 34, the lips 33 extend partially over the respective backing side edges 42 and compress the pile 43. The strips 40 are thereby relatively securely retained in respective channels 30 and are readily removable for replacement when worn to the extent that they are no longer effective for removing and retaining foreign matter. The placement of the strip side edges 42 in respective slots 34 tends to prevent the carpet strips 40 from working loose and posing a hazard to persons walking over the floor mat 1. The piles 43 of respective carpet strips 40 are adapted for providing a brushing-type action on the footwear of persons walking thereover, thereby removing water, dirt and other foreign matter therefrom. Also, the piles 43 are adapted for retaining such foreign matter until such time as the floor mat 1 is cleaned or the strips 40 thereof replaced.

Figure 1:
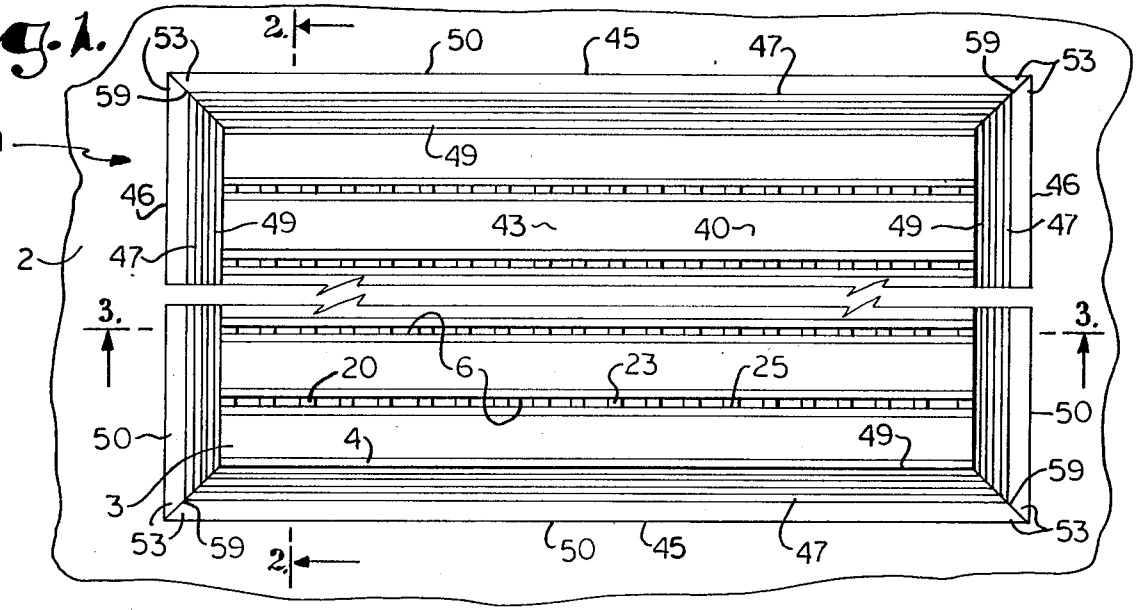
FIG. 1 is a fragmentary, plan view of a floor mat embodying the present invention.

As shown in FIG. 1, the floor mat 1 has a generally rectangular configuration in plan and is framed by opposite pairs of lengthwise threshold members 45 and transverse threshold members 46. The threshold members 45 and 46 each include upper and lower surfaces 47 and 48 respectively, inner and outer edges 49 and 50 respectively, and a pair of opposite mitered ends 53. An extension 51 extends inwardly from the inner edges 49 of each threshold member 45 and 46 substantially flush with its lower surface 48. As shown in FIGS. 2 and 3, the threshold member upper surfaces 47 slope upwardly from slightly above support surface 2 at their respective outer edges 50 to a level flush with the rail upper surfaces 4 at their respective inner edges 49, whereby the threshold members 45 and 46 have a tapered cross-sectional configuration. A plurality of spaced grooves 52 extend longitudinally of and open onto the upper surfaces 47 of the threshold members 45 and 46. The grooves 52 function to reduce the likelihood of a person's footwear slipping with respect to the floor mat 1 and also to remove foreign matter therefrom.

As shown in FIG. 2, each lengthwise threshold member 45 includes a threshold hinge member 55 extending from the inner edge 49 thereof and comprising a threshold web 56 and a threshold flange 57. The threshold hinge member 55 has a T-shaped cross-sectional configuration corresponding to the cross-sectional configuration of the passageways 10. The threshold web 56 and flange 57 are slidably received in inner and outer portions 11 and 12 respectively of passageways 10 of the outermost rails 3. The side edges 6 of the outermost rails 3 are thus secured in mutually opposed engagement with the inner edges 49 of the lengthwise threshold members 45 and the extensions 51 thereof are positioned under rail lower surfaces 5. With the threshold member extensions 51 thus positioned between the lower surfaces 5 of the outermost rails 3 and the support surface 2, the extensions 51 provide a cushioning effect when the outermost rails 3 are walked on.

Economy in manufacture of the floor mat 1 is provided because the outermost rails 3 are identified to the others and do not require a different structure to attach the lengthwise threshold members 45. All of the rails 3 may thereby be extruded with a single die.

The transverse threshold members 46 are substantially identical to the lengthwise threshold members 45 except that they lack the threshold hinge members 55. The extensions 51 of the transverse threshold members 46 are positioned between the support surface 2 and the rail lower surfaces 5 adjacent their opposite ends 8. As shown in FIG. 3, the rail opposite ends 8 are positioned in abutting relationship with respect to the inner edges 49 of the transverse threshold members 46. The rail opposite ends 8 are attached to respective transverse threshold member extensions 51 by rivets 44 which also extend through respective carpet strip backings 41.

The lengthwise and transverse threshold members 45 and 46 respectively are joined at their respective intersections by miters joints 59 whereat their mitered ends 53 may be connected in abutting relationship by any suitable means. The threshold members 45 and 46 thus provide a smooth, slightly inclined transition from the support surface 2 to the level of the rail upper surfaces 4. The rivets 58 extend through respective extensions 51, rail ends 8 and strip backings 41 and are adapted for retaining these together.

The rails 3 each include a pair of lower passageways 65 opening onto their respective lower surfaces and extending longitudinally of the rails 3 in parallel, spaced relationship (FIG. 3). The lower passageways 65 are each adapted to slidably receive a respective elongated cushion 66 therein which projects below the rail lower surface 5 and functions to space and cushion the rail 3 with respect to the support surface 2. The elongated cushions 66 preferably comprise a durable, resilient material such as vinyl.

In operation, the floor mat 1 may be placed adjacent the entrance to a building in a location where persons entering same will walk over it. The floor mat 1 of the present invention provides a variety of means for removing and retaining dirt, water and other foreign matter from the footwear of persons walking thereover. The piles 43 of the carpet strips 40 are adapted for providing a brushing-type action with respect to such footwear and will retain a significant amount of such foreign matter. The grooves 13 of the rails 3 and the threshold member grooves 52 also provide receptacles for such foreign matter. Further, dirt, water and other matter may fall between the rail side edges 6 and thence through the cut-outs 25 to the support surface 2.

The flexible hinge members 20, the threshold members 45 and 46, the elongated cushions 66 and the carpet strips 40 cooperate to provide a cushioning effect of the floor mat 1 when walked on. This cushioning effect, in addition to making the floor mat 1 more comfortable to walk on, also facilitates its cleaning functions because the various elements thereof are allowed to displace vertically with respect to each other. For example, the rigid rails 3 may oscillate vertically and somewhat independently with respect to each other because the hinge members connecting same are flexible to allow such vertical displacement. As the rails 3 displace vertically, the piles 43 of the carpet strips 40 tend to brush the footwear of a person walking thereover, thereby increasing the cleaning efficiency of the floor mat 1. Further, the aforementioned flexible elements of the floor mat 1 are adapted to withstand and absorb the shock of not only normal pedestrian traffic, but also of a person stamping his feet thereon to remove foreign matter from his footwear.

The roll-up feature of floor mat 1 provides for easy removal thereof from the support surface 2, thereby facilitating cleaning and storage. For example, when the floor mat 1 becomes saturated with foreign matter such that it no longer cleans footwear, it may be rolled up and removed to a remote location for cleaning. Also, the floor mat 1 or portions thereof may be rolled up to facilitate cleaning the support surface 2 thereunder. Installation of the floor mat 1 is facilitated because the roll-up feature thereof allows floor mats 1 of virtually any desired dimensions to be assembled elsewhere and easily transported to and placed in a desired position adjacent the entrance to a structure.

The rigidity of the elongated rails 3 contributes to the effectiveness of the floor mat 1 because they are capable of withstanding heavy traffic and use for extended periods of time. Further, they provide a necessary means for retaining the carpet strips 40, which may be replaced when worn out thereby further contributing to the longevity of the floor mat 1. Further, the rigid rails are maintained in a predetermined, spaced relationship by the hinge members 20 whereby narrow heals of persons walking over the floor mat 1 are prevented from being entrapped between the rails 3. The floor mat 1 presents a relatively low profile above the support surface 2 thereby reducing the likelihood of a person tripping thereon.

The reference number 101 generally designates a floor mat comprising a second embodiment of the present invention and recessed into a support surface 102. The floor mat 101 comprises a plurality of rigid, elongated rails 103 each having an upper and a lower surface 4 and 5 respectively, opposite side edges 6 and opposite ends 8. Each rail 103 includes a pair of passageways 110 extending longitudinally thereof and having an inner portion 111 and an outer portion 112 adjacent a respective rail side edge 106. Each rail 103 includes a plurality of spaced, elongated grooves 113 opening onto its upper surface 104. Each rail 103 includes an upper and a lower rib 115 and 116 extending longitudinally in mutually opposed relationship adjacent its respective side edges 106, each pair of upper and lower ribs 115 and 116 forming a respective passageway outer portion 112 therebetween.

Each pair of adjacent rails 103 are interconnected by a respective hinge member 120 having a web 123 with side margins 121 extending therealong and a pair of elongated, opposite flanges 122 each extending along a respective web side margin 121, the flanges 122 being interconnected by and integrally connected to the web 123. Each hinge member 120 includes a plurality of longitudinally spaced cut-outs 125 extending through the web thereof.

Each rail 103 includes a shallow channel 130 extending longitudinally thereof and opening onto the rail upper surface 104. The channels 130 are each defined by a respective bottom surface and a pair of opposite side walls with a pair of mutually opposed lips 133 extending inwardly therefrom and forming a pair of opposite slots 134 opening inwardly into the channel 130.

Each shallow channel 130 includes a carpet strip 140 comprising a semi-rigid backing 141, opposite side edges 142 and a fibrous pile 143 removably retained therein. The semi-rigid backing side edges 142 are each received in a respective slot 134 and extend under respective lips 133 which partially compress the carpet strip pile 143, thereby preventing the carpet strip backing side edges 142 from pulling loose. The carpet strips 140 are also secured to the rails 103 within channels 130 by means of rivets 144 extending through the carpet backing 141 and respective rails 103, the rivets 144 engaging respective rail lower surfaces 105.

A pair of lengthwise threshold members 145 each extend longitudinally of the floor mat 101 adjacent the opposite outermost rails 103. Each lengthwise threshold member 145 displays upper and lower surfaces 147 and 148 respectively, inner and outer edges 149 and 150 respectively, and an extension 151, and grooves 152 opening onto its upper surface 147. As shown in FIG. 3, a threshold hinge member 155 extends longitudinally of each threshold member inner edge 149 and projects therefrom. Each threshold hinge member includes a threshold web 156 and a threshold flange 157 attached thereto. The threshold hinge members 155 are each adapted to be slidaly received in a respective rail passageway 110 with the threshold webs 156 in the passageway outer portions 112 and the threshold flanges 157 in the passageway inner portions 111, whereby the outermost rail side edges 106 engage respective threshold member inner edges 149 in mutually opposed relationship.

Each rail 103 includes a pair of spaced lower passageways 165 extending longitudinally thereof and opening onto the rail lower surface 105. An elongated cushion 166 is slidably received in each respective lower passageway 165 and protrudes from a respective rail lower surface 105 (FIG. 6).

The floor mat 101 is adapted to be removably received in a shallow recess 159 with a bottom surface 160 in the support surface 102. A frame 161 is fixedly positioned in the recess 159 and is preferably anchored to the support surface 102 by mechanical fasteners, such as the anchor bolts 162 as shown. The the frame 161 with the anchor bolts 162 attached thereto is preferably placed in a predetermined position prior to constructing the support surface 102 by, for example, pouring concrete around the frame 161 and the anchor bolts 162. The frame 161 displays inner edges 164 and upper edges 163 substantially flush with the support surface 102.

Figure 6:
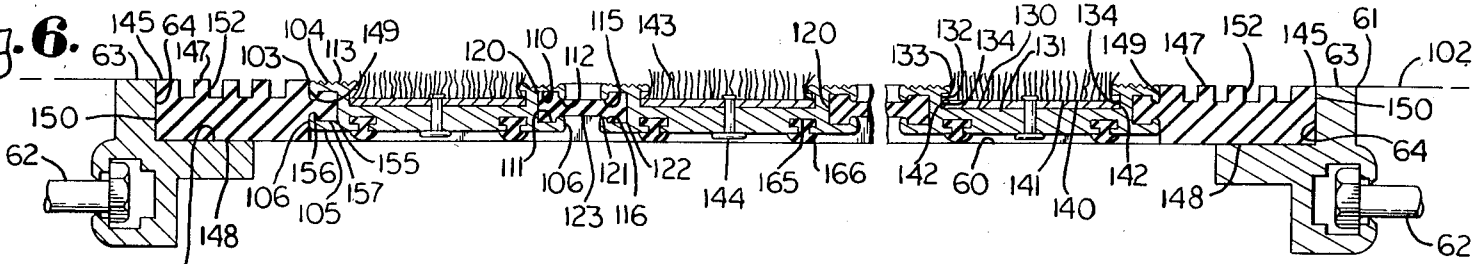
FIG. 6 is an enlarged, fragmentary cross-sectional view of the floor mat taken generally along line 6—6 in FIG. 5.

With the floor mat 101 placed within the recess 159, the threshold member outer edges 150 and the rail ends 108 abut the frame inner edges 164 in mutually opposed relationship (FIGS. 6 and 7). The elongated cushions 164 function to space the rail lower surfaces 105 above the recess bottom surface 160 and cushion the floor mat 101. The threshold member upper surfaces 147 are positioned substantially flush with the frame upper edges 163 and the support surface 102. The carpet strip piles 143 project slightly above the level of the support surface 102, the threshold member upper surface 147, and the rail upper surfaces 104, thereby providing a brushing action on the footwear of persons walking over the floor mat 101.

Figure 8:
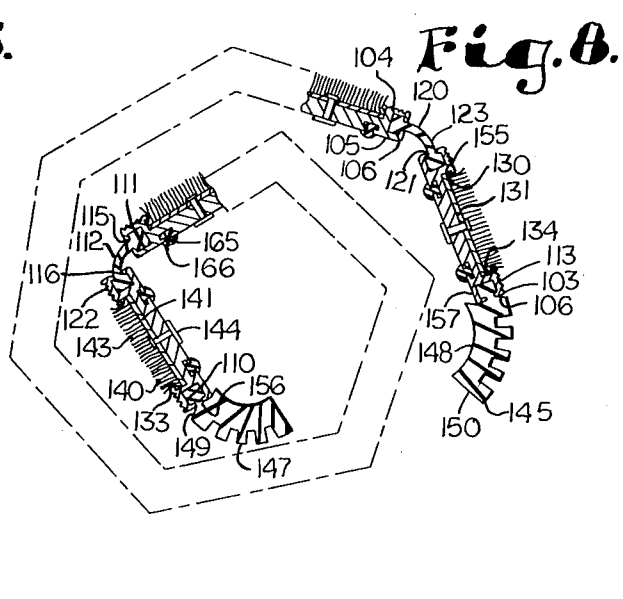
FIG. 8 is an enlarged, transverse cross-sectional view of the floor mat in a rolled-up position.
Figure 5:
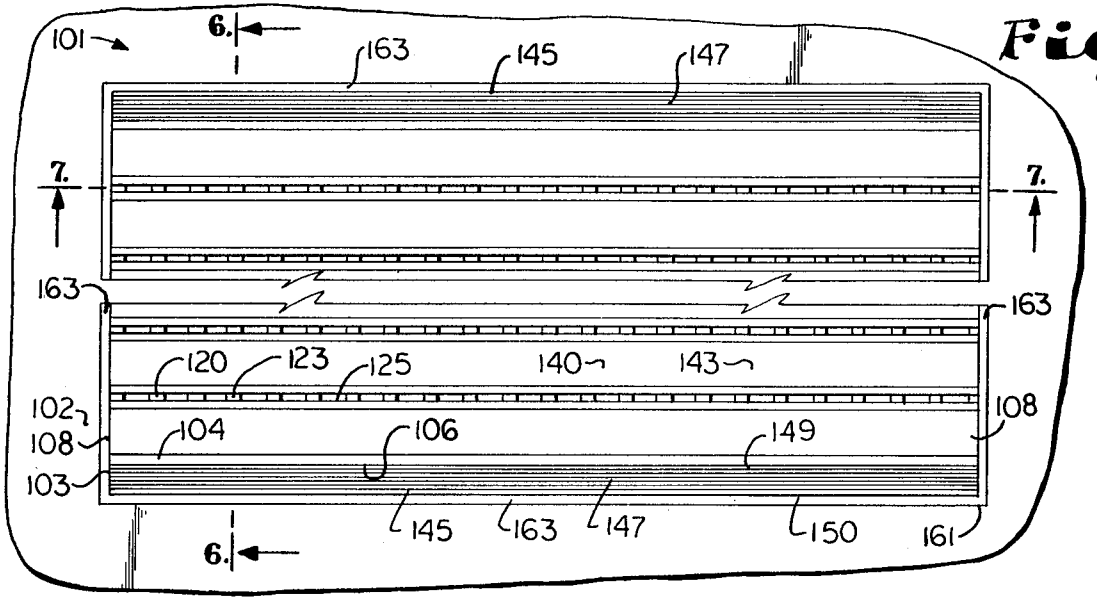
FIG. 5 is a fragmentary, top plan view of a second embodiment of the present invention, showing a floor mat placed in a shallow recess of a floor.

The floor mat 101 functions in a substantially similar manner to the previously described embodiment of the present invention, the floor mat 1. The floor mat 101 may likewise be easily removed from the recess 159 by rolling it up to a configuration as shown in FIG. 8, with the hinge members 120 bending transversely about their longitudinal axes to allow transverse angular displacement between adjacent pairs of the rails 103.

It is to be understood that while I have illustrated and described certain forms of my invention, it is not to be limited to the specific forms or arrangement of parts herein described and shown.

What is claimed and desired to secure by Letters Patent is:

1. A floor mat which comprises:

(a) a plurality of rigid, elongated rails each including:

(1) a pair of opposite side edges, at least one of said side edges being positioned in mutually opposed, substantially parallel spaced relationship to a respective side edge of an adjacent said rail;

(2) a pair of elongated passageways extending longitudinally through said rail, each said passageway having an outer portion open at a respective said side edge and an enlarged inner portion;

(3) an upper tread surface; and (4) a uniform, continuous cross-sectional configuration; and (b) a plurality of elongated, flexible hinge members each interconnecting a respective adjacent pair of said rails at their side edges, each of said hinge members including:

(1) a web with opposite side margins; and (2) a pair of opposite spaced flanges each integrally attached to said web at a respective web side margin;

(3) each said flange being slidably received in a respective passageway inner portion and said web side margins each being slidably received in a respective passageway outer portion;

(c) said flexible hinge members being adapted to allow vertical displacement of said rails with respect to each other when said floor mat is walked on;

(d) said flexible hinge members maintaining said rails in uniform, spaced relation with said floor mat in a flat configuration;

(e) said flexible hinge member webs being adapted to bend transversely about longitudinal axes thereof whereby said floor mat is adapted to be rolled up by folding said rails with respect to each other.

2. The floor mat as set forth in claim 1 which includes:

(a) each said rail having a channel opening onto an upper tread surface associated therewith; and (b) a plurality of carpet strips each positioned in a respective channel and extending longitudinally of a respective rail.

3. The floor mat as set forth in claim 2 which includes:

(a) each said channel including:

(1) a bottom surface;

(2) a pair of opposed side walls; and (3) a pair of opposed lips each extending inwardly from a respective side wall in spaced relation from said bottom surface whereby each said channel includes a pair of opposed, inwardly-opening slots; and (b) each said carpet strip including a backing with opposite side margins each received in a respective inwardly-opening slot whereby said carpet strip is retained in said channel.

4. The floor mat as set forth in claim 3 wherein:

(a) each said carpet strip backing is adhesively attached to a respective channel bottom surface.

5. The floor mat as set forth in claim 1 which includes:

(a) a pair of elongated threshold members each having an inner edge attached to a respective rail and an outer edge, each said threshold member having a cross-sectional configuration tapered from said inner edge to said outer edge and an upper surface sloping downwardly from said inner edge to said outer edge.

6. The floor mat as set forth in claim 5 wherein:

(a) said pair of threshold members comprise lengthwise threshold members;

(b) a transverse pair of threshold members;

(c) said threshold members surrounding said floor mat and comprising a flexible, resilient material.

7. The floor mat as set forth in claim 1 which includes:

(a) said floormat being adapted for being recessed into a floor surface;

(b) a frame adapted for being recessed into said floor surface and surrounding said floor mat; and (c) said rail upper tread surfaces being adapted for being substantially flush with said floor surface.

8. The floor mat as set forth in claim 1 which includes:

(a) each said rail having a lower surface; and (b) said floor mat being placed on a support surface; and (c) a plurality of elastomeric cushioning strips each attached to a respective rail lower surface and adapted for spacing said lower surface above said support surface.

9. The floor mat as set forth in claim 1 which includes:

(a) each said hinge member having a plurality of longitudinally spaced cut-outs extending through said web.

10. The floor mat as set forth in claim 1 which includes:

(a) a pair of opposite, flexible elongated threshold members each having a side edge and being attached to a respective rail side edge;

(b) each said threshold member having a threshold flange extending longitudinally of said threshold side edge in spaced relation therefrom and slidably received in a respective passageway inner portion and a threshold web extending between said threshold side edge and said threshold flange, said threshold web being slidably received in said passageway outer portion whereby said threshold member is attached to said rail with said threshold member said edge and rail side edge in mutually opposed relationship.

11. The floor mat as set forth in claim 1 which includes:

(a) each of said rails having a channel opening onto an upper surface associated therewith; and (b) a plurality of elongated strips comprising a fibrous material each positioned in a respective channel.

12. A floor mat which comprises:

(a) a plurality of rigid, elongated rails each including:

(1) a pair of opposite side edges, at least one of said side edges being positioned in mutually opposed, substantially parallel spaced relationship to a respective side edge of an adjacent one of said rails;

(2) a passageway opening inwardly from each said rail side edge and extending parallel to said side edge for the length of said rail associated therewith, each said passageway having an outer portion at said side edge and an enlarged inner portion within said rail;

(3) an upper tread surface;

(4) a channel opening onto said rail upper tread surface and having a bottom surface, a pair of opposed side walls and a pair of opposed lips each extending inwardly from a respective side wall in spaced relation from said bottom surface thereby defining a pair of opposed, inwardly-opening slots; and (5) a uniform, longitudinally continuous cross-sectional configuration;

(b) a plurality of elongated, resilient, flexible hinge members interconnecting each adjacent pair of said rails at their side edges, each of said hinge members including:

(1) a web with opposite side margins; and (2) a pair of opposite, spaced flanges each integrally attached to said web at a respective web side margin;

(3) said hinge member being thicker at said flanges than at said web;

(c) each said flange being slidably received in a respective passageway inner portion and said web side margins each being slidably received in a respective passageway outer portion;

(d) a plurality of carpet strips each positioned in a respective channel and including:

(1) a backing with opposite side margins each received in a respective inwardly-opening slot whereby said carpet strip is retained in said channel; and (2) a fibrous pile attached to said carpet backing and extending upwardly therefrom above the level of said upper tread surface; and (e) a pair of opposite flexible elongated threshold members each attached to a respective rail side edge, each said threshold member including:

(1) a threshold side edge;

(2) a threshold flange extending longitudinally of said threshold side edge in spaced relation therefrom and slidably received in a respective passageway inner portion; and (3) a threshold web extending between said threshold side edge and said threshold flange, said threshold web being slidably received in said passageway outer portion whereby said threshold member is attached to said rail with said threshold member and said rail side edges in mutually opposed relationship;

(f) said flexible hinge members being adapted to allow vertical displacement of said rails with respect to each other when said floor mat is walked on;

(g) said flexible hinge members maintaining said rails in uniform, spaced relation with said floor mat in a flat configuration;

(h) said flexible hinge member webs being adapted to bend transversely about longitudinal axes thereof whereby said said floor mat is adapted to be rolled up by folding said rails with respect to each other.

13. A floor covering consisting of coupled sections, having in combination a floor covering section substantially rectangular in plan, a flange formed at each side edge portion of said section, each flange having a longitudinal bore therethrough, said bores respectively having oppositely facing slots, a coupling member comprising a pair of closely spaced rods, a web connecting said rods, said web having a thickness less than the height of said slots, said rods respectively being disposed through adjacent pairs of said slots connecting a pair of said sections, and a tread surface carried by said sections.

14. The structure of claim 13, including means securing said rods within said bores preventing relative longitudinal movement thereof.

15. The structure of claim 13, wherein said web has cut out spaces therein.

16. The structure of claim 13, wherein said flanges having a recessed area therebetween, and a tread including said tread surface disposed into said recessed area.

* * * * *